United States Patent [19]

Cardia et al.

[11] Patent Number: 5,000,600

[45] Date of Patent: Mar. 19, 1991

[54] DISPENSING CONTAINER OF A SOLIDIFIED COSMETIC STICK

[76] Inventors: Ennio Cardia; Anna M. Ballarati, both of 18 Via Durazzo, I-00195 Roma RM, Italy

[21] Appl. No.: 501,228

[22] Filed: Mar. 29, 1990

[30] Foreign Application Priority Data

Apr. 3, 1989 [IT] Italy ..... 47805 A/89

[51] Int. Cl.[5] ..... A45D 40/04

[52] U.S. Cl. ..... 401/75; 401/175; 222/390

[58] Field of Search ..... 222/390, 391; 401/75, 401/175, 171, 174, 68, 78

[56] References Cited

U.S. PATENT DOCUMENTS

| | | | |
|---|---|---|---|
| 976,945 | 11/1910 | Stone | 222/390 |
| 1,657,273 | 1/1928 | Nymann | 222/390 |
| 2,816,309 | 12/1957 | Worth | 401/175 |
| 3,241,729 | 3/1966 | Gabler | 222/390 |
| 3,333,740 | 8/1967 | Waller | 401/75 X |
| 3,902,814 | 9/1975 | Cardia | 401/66 |
| 4,263,560 | 12/1982 | Gentile | 401/175 |
| 4,813,801 | 3/1989 | Cardia | 401/78 |

*Primary Examiner*—Richard J. Johnson

*Attorney, Agent, or Firm*—Browdy and Neimark

[57] ABSTRACT

A container particularly for cosmetic or pharmaceutical products, in stick or cream form, dispenses the product by rotating the upper part of the container with respect to the lower part, provided with peripheral friction sealing systems for good conservation of the product, shaft-led axial guiding systems and systems for making separately produced bodies integral one with the other.

16 Claims, 3 Drawing Sheets

DISPENSING CONTAINER OF A SOLIDIFIED COSMETIC STICK

BACKGROUND OF THE INVENTION

1. Field of the invention

The present invention refers to a container functioning as a product dispenser, generally for cosmetic or pharmaceutical type products under solidified fluid stick form, such as deodorants or lip-sticks, or for viscous fluids, such as creams, gels and the like.

The container is of the type which includes a propelling carrier with a central threaded aperture, functioning as a stick holder cup or a pressing piston having a rotational and sliding movement controlled by an axial screw threaded shaft, following a relative rotation of two outer bodies of the container which are rotatable one to other.

2. Description of the Prior Art

Containers of this general type are already known from prior art, examples of which are containers for lipsticks and stick-deodorants present on the market, and those described in the published European patent application No. 0332593, also including cream dispensers.

The container dispensers described in the above patent applications, comprise a tubular outer case with a circular cross sectional internal surface, open on its upper part and closed at its base, and a screw threaded shaft rigidly connected to the closed base, projecting along the axis of the case, a tubular inner sheath, coaxial to the outer case, with a lower part having a rotatable cylindrical outer surface in sliding contact with the inner surface of the case and a closed base provided with a hole, and an upper part projecting above the case, a movable carrier threadedly engaged with the screw shaft through the central aperture, and having a transversal diaphram and an outer wall in sliding contact with the inner surface of the inner sheath, forming an elastic friction sealing, engagement means on the sheath and on the case suitable for preventing a relative movement in the axial direction of the sheath and the case, so that these may achieve only a relative rotational movement around their common longitudinal axis, and a cap.

The process of moulding the shaft in a single piece with the base of the outer case can be difficult, the shaft being moulded inside a beaker-shaped case, and provided with a series of undercuts resulting from the reduced pitch thread.

In the above mentioned Italian patent application 47736A89 there have been illustrated shafts provided with a basal platform, moulded separately from the bottom of the case and subsequently made integral by engagement between surfaces which extend in an axial direction.

One must take into account that the ease of moulding of such bodies which make up the container is of fundamental practical and commercial importance.

Other conventional containers present on the market for stick products contain a carrier or cup screwed onto a shaft integral with the outer case and sliding along the inside of the inner sheath. The carrier is normally provided with one or more guiding grooves on its outer surface which engage with respective guiding splines on the inner surface of the inner sheath, in a way to be forced to move in an axial direction, to avoid that the rotation of the outer case drags it in joint rotation.

The presence of splines is often prejudicial to the external appearance of the stick product.

SUMMARY OF THE INVENTION

The container of the present invention has a hermetically sealed coupling between propelling carrier and the inner body or sheath, without grooves or respective axial guiding splines.

In fact, a rod displaced relative to the centre and projecting in an axial direction to the top and which passes through the propelling carrier prevents the latter to rotate with respect to the inner case, aiding it in the sliding movement in the axial direction.

In addition to said advantage, the following further advantages are gained according to the present invention.

The screw shaft can be moulded separately from the main outer case and can be easily coupled in a rigid manner to the base of the outer case. The coupling can be realized by a simple glueing operation, for example by ultrasound, or by forced pressure which generates binding or by snap fastening between the relative projecting and opposite surfaces of the outer case and the shaft.

The wall of the inner sheath can be of variable thickness. In fact, whilst the outer surface of said wall is circular in section to slide on the inner surface of the case, the inner surface of said wall can be of non-circular section. For example it can be elliptical, oval, heart-shaped, poligonal and the like. In fact, the carrier must slide axially and adhere to this surface by friction.

The outer case and the inner sheath may be realized in transparent material so that the carrier and the product may be seen from the outside.

BRIEF DESCRIPTION OF THE DRAWINGS

Other characteristics and advantages of the present invention will become more evident from the following description of preferred embodiments, with reference to the accompaning drawings, in which.

DESCRIPTION OF THE PREFERRED EMBODIMENTS

Figure 1:
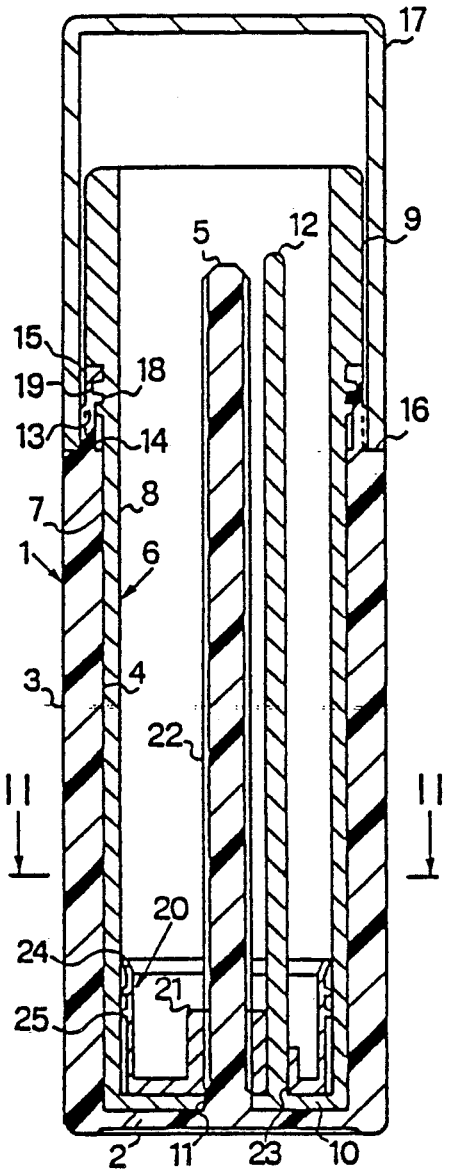
FIG. 1 is a longitudinal section of a dispenser container according to the invention, particularly for stick products.
Figure 2:
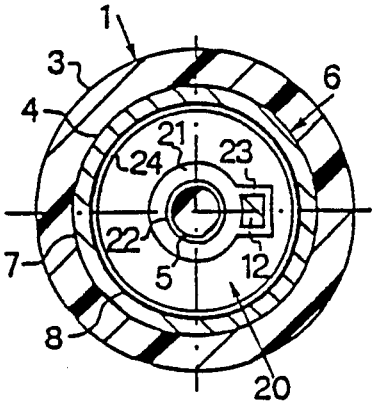
FIG. 2 is the section along line II—II of FIG. 1.

With reference to FIG. 1 and FIG. 2, the container dispenser of the present invention is shown in an embodiment suitable for containing solidified fluid product, that is those commoly called "stick" product, such as deodorants, lip-sticks and the like. More particularly, FIG. 1 is suitable as a container for lip cream.

The following components of the container according to the invention are common to all the embodiments shown, both for solidified products and for creamy type products.

A tubular outer case 1 is closed at its bottom end by base 2 and open at its corresponding top end. It has an outer surface 3 and an inner surface 4 with a circular cross-section, perpendicular to the longitudinal axis of the case.

Integral to the base 2 and extending towards the top of the case 1 is a screw shaft 5.

A tubular inner sheath 6 is inserted coaxially to the case 1 and its outer surface 7 of circular cross-section is in sliding contact with the inner surface 4 of the case 1. Its inner surface is indicated 8. The sheath 6 projects further with respect to case 1 by a projecting portion 9. The upper end of the sheath is open and the lower end closed by a transversal bottom wall 10, having a central aperture 11. A guiding rod 12 projects upwardly in an axial direction from the bottom 10 of the sheath 6 and is off-centre with respect to the container's axis.

The outer case 1 and the inner sheath 6 can rotate, with respect to each other, sliding along the inner surface 4 and the outer surface 7, respectively, around their common longitudinal axis.. They are however constrained respect to a movement in the axial direction.

The constraint which prevents their relative axial movement can be realized in several ways.

In FIG. 1, the constraint is realized in correspondence to the top of the case 1.

The outer case 1 narrows at the upper end providing a wall 13 of reduced thickness. The reduced thickness can be realized as shown in 14, starting from the inner surface 4, or as shown in 15, starting from the outer surface 3 of the case 1. In such a way the wall 13 provides on the outer wall a shelf 16 on which a cap 17 can be rested.

The wall 13 of the case 1 provides one or more annular ribbings 18 projecting inwardly, between which are formed recesses in which the analogous annular ribbings 19 are coupled projecting inwardly into the sheath. This coupling, which occurs by snap fastening in the assembly operation of the container, prevents the relative axial shift by the case 1 in the sheath 6, nevertheless allowing a reciprocal rotation.

A movable propelling carrier 20 with rotational and sliding movement is shown in its extreme retracted bottom position.

The carrier, in the case of the embodiment of FIG. 1, consists of a cup which serves to hold the product and push it upwardly for use.

In the case of solidified stick products, the carrier has a cup-like shape, whereas in the case of cream products it has a pushing piston shape.

In the continuing description the terms "cup" and "piston" will be used as synonyms to "carrier", depending on the case.

In the embodiment of FIG. 1 the cup 20 is threadedly coupled with a screw thread 22 of the shaft 5 by way of a threaded tubular inner boss 21. On the bottom of the cup, an appropriate offset aperture 23 is provided, through which the guide rod 12 slides. The guide rod 12 does not allow the cup 20 to rotate about the axis of the internal body 6 so that it is not necessary to provide guiding ribbings on the inner surface 8 of the sheath 6.

The cup 20 has an outer wall structure which generates a frictional resistance in the sliding movement of the cup 20 on the inner surface 8 of the sheath 6.

This frictional resistance is obtained by a flaring 24 on the upper edge of the cup, which proceeds to scrape the inner surface 8, and also by annular ribs 25 on the cup, projecting externally, to aid scraping and to maintain the alignment.

In this way the stick product projecting from the internal sheath 6 is devoid of the unestethic traces of the guiding ribbings.

A cap 17 is in contact with the external body 1 on the ledge 16 and on the outer surface 15 of the reduced thickness wall 13, while it is not in contact with the projecting portion 9 of the inner body 6.

With the cap 17 applied, only the outline of the ledge 16 will be visible externally and this allows the outer surface 3 and the respective base 2 of the case 1 and the cap 17 to be given any external cross sectional configuration.

The operation for the rotating and sliding movement of the cup 20 occurs by making the inner body rotate relative to the outer body 1, or viceversa.

The rotation occurs sliding between the inner surface 4 of the case 1 and outer surface 7 of the sheath 6. As a consequence, the inner surface 8 of the sheath 6 can assume any cross sectional configuration , such that the cross-section of the stick can also be realized to liking with different shapes to that circular, such as elliptical, oval, heart-shaped, poligonal and the like.

The illustrated structure shows the advantage that in realizing the sheath 6 with transparent material it is possible to see the upper part of the product through transparency, without removing the cap, provided the cap is also transparent. Furthermore, if the outer case 1 is also transparent, it is possible to see the propelling carrier and the product held by it.

Generally the case 1 and the sheath 6 can be realized by more components. This may be necessary for moulding purposes or for reasons of compatibility between the various plastic materials with the product to be contained.

Furthermore, the constraint which prevents the axial movement of the case and the sheath can be realized both in correspondence to the top, as shown in FIG. 1, and in correspondence to the bottom end, as illustrated in other embodiments.

In the various embodiments which are illustrated below, the same reference numbers of FIG. 1 have, in as far as possible, been used to indicate similar items.

In FIG. 1, the container is shown in section along line II—II of FIG. 1.

The coupling of the cup with the inner wall of the sheath 6, by the flared upper edge 24 of the cup which pushes elastically on the wall 3, is characterized in this case by an uninterrupted line without grooves and respective ribbings, capable of affording further to an efficient elastic friction also an excellent hermetic seal. The crossing of the guiding shaft 12 in the aperture 23, on the floor of the cup is also shown.

Figure 3:
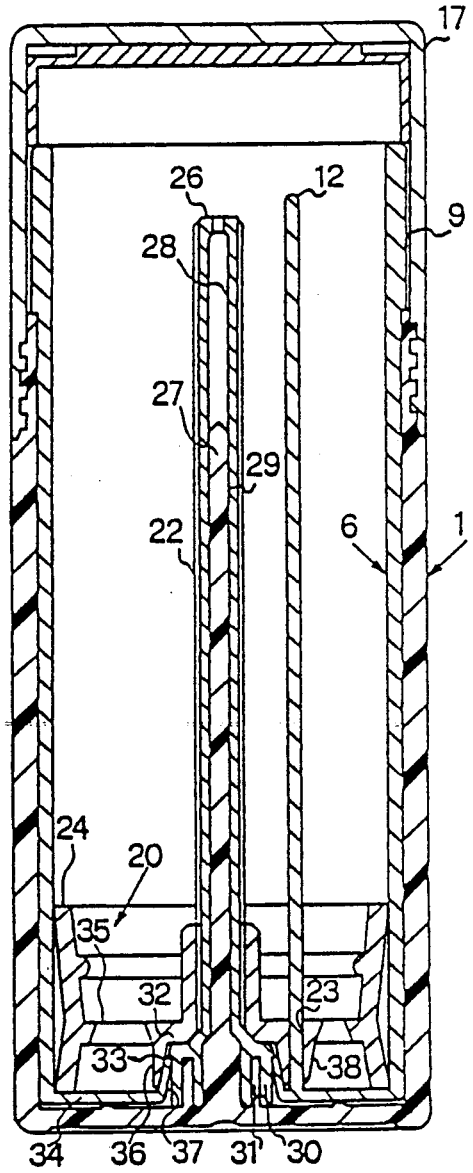
FIG. 3 is a modification of FIG. 2, suitable for deodorant products.

In FIG. 3 an embodiment suited for a deodorant stick product is shown, where the hermetic seal is particularly cared for.

In this embodiment, the engagement between the sheath 6 with the case 1 and a hollow screw threaded member 26, rigidly connected with each other to be integral, is realized at the bottom, instead of the top.

The hollow screw threaded member 26 is rigidly connected to a post 27 projecting axially from the base 2 of the case 1 towards the top. The rigid engagement between the two members can occur by glueing, for example by ultrasound, or by forced compression which generates binding between the surfaces of the hollow screw threaded member and the projecting post 27. The hollow member merges, close to the base, with a flange 30, projecting downwardly which is engaged by fitting, or by pressure, or by glueing, with a respective flange 31 projecting from the bottom of the case 1 towards the top.

On this joining surface between the hollow member 26 and the flange 30 a radial rib 32 is realized, preferably annular, which is engaged with a central aperture 33 on the bottom wall 34 of the case, to afford a constraint in an axial direction.

To this end, the sheath 6 is assembled on the case 1 by letting the hollow screw threaded member 26 slide into the flange 33 until the rib 32 snaps into place above the aperture edge 33, blocking the sheath 6. The flange 30 is made integral beforehand with respect to the post 27 and with the wall 31 of the base 2 of the case 1. The cup 20 is provided with apertures 35 on its floor to allow that, when the product is poured from the top of the body 6, in its fluid state, it can gather on the underlying space delimited by the lower inner surface of the outer wall of the cup 20, by the bottom wall 34 of the sheath 6 and by a flange 36.

The flange 36 projects from the floor of the cup and adheres with elastic friction to the bottom 34 of the sheath 6 and to a projection 37 of the same, so as to afford a hermetic seal.

A tubular appendix 38, projecting downwardly is provided around the aperture 23 on the floor of the cup, to give a larger contact surface with the guide rod 12.

Figure 4:
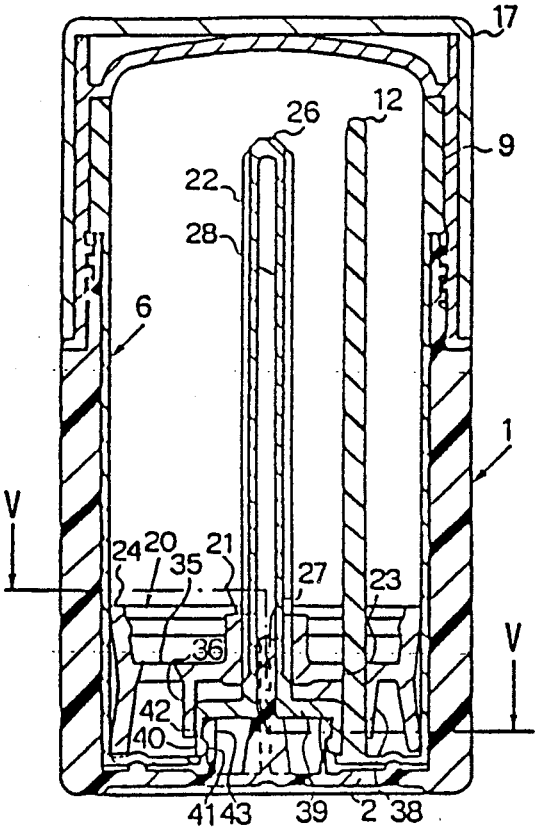
FIG. 4 is a modification of FIG. 3.

In FIG. 4 a further modification is shown for rigidly connecting the shaft 26 with the base 2 of the case 1.

In this embodiment the post 27, projecting from the base 2, has a star-shaped cross-sectional structure and a reduced height, being only partially inserted on the lower part of the hollow member 28 of the screw shaft 26.

The screw shaft 26 is provided with a lower platform 39 having on its periphery a plurality of tongues 40, turned downwardly. On their extremities, the tongues 40 have small lugs 41 turned internally, functioning as small undercuts. The lugs 41 are snap locked with respective and directly opposite small lugs 42, turned outwardly, born by respective tongues 43, projecting upwardly from the base 2.

When the lugs 41 and 42 are locked, the platform 39 with the screw shaft 26, is made rigid with the base 2 of the case.

Therefore, the shaft 26 and the outer case 1 behave as a single piece, even if moulded separately.

Figure 5:
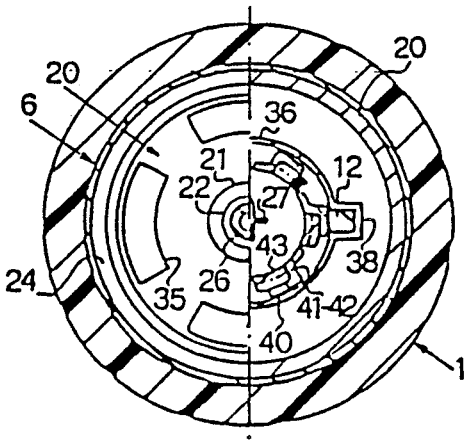
FIG. 5 is a section along line V—V of FIG. 4.

FIG. 5 shows a cross section along line V—V of FIG. 4, on two levels, where the left side of FIG. 5 is at an elevated level with respect to the cup, whilst the right side is at a corresponding level to the engagement between the respective lugs 41 and 42. On the left side of FIG. 5 the transversal diaphram or floor of the cup is visible, having apertures 35 to allow the fluid product to perculate in the underlying space, as has been described in the embodiment of FIG. 3.

On the right side of FIG. 5 the guiding rod 12 is shown in section, surrounded by the appendix 38 which merges with the wall 36 and projects downwardly. Furthermore there are shown the star-shaped section of the post 27 and the lugs 41 and 42 born by respective tongues 40 on platform 39, and the respective tongues 43 of the base 2.

On the right side of FIG. 5 a better illustrated detail is shown, furthermore, of the particular realization of the tongues 40 which are joined at 44, in a Z-shaped course, with as many positioning or centering adjacent tongues 45, placed on a slightly smaller diameter.

Figure 6:
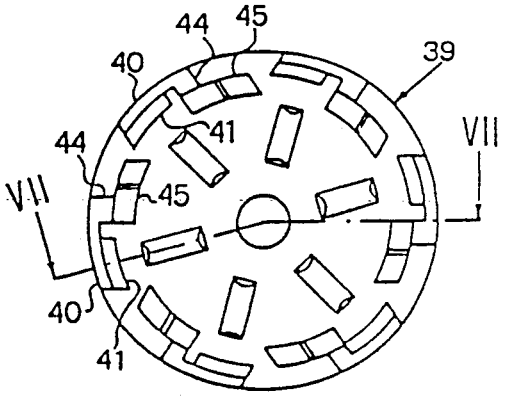
FIG. 6 is a bottom view of a detail regarding the snap fastening means on the platform integral with the shaft of FIG. 4.

In FIG. 6 an enlarged detail of the platform 39 is shown, seen from the bottom, with the tongues 40 and 45 joined between themselves in a Z shape from the joining 44.

Figure 7:
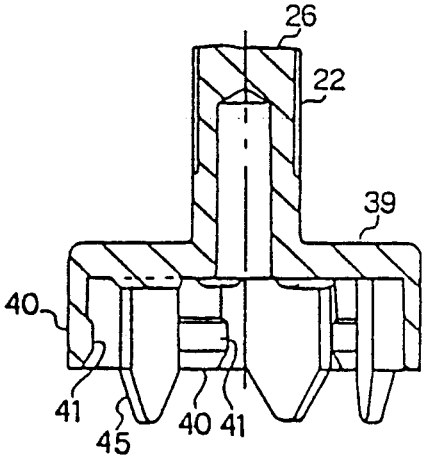
FIG. 7 is a longitudinal section along line VII—VII of FIG. 6 which shows the snap fastening means projecting downwards.

In FIG. 7 the details of FIG. 6 are visible in longitudinal section.

Figure 8:
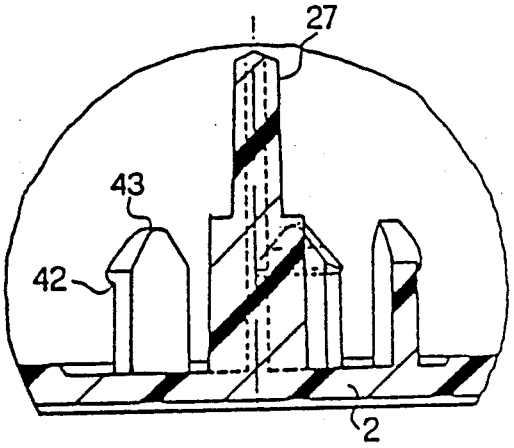
FIG. 8 is a longitudinal section view of a detail regarding the snap fastening means on the bottom of the case of FIG. 4 which engage with the respective snap fastening means onto the platform integral with the shaft of FIGS. 6 and 7.

In FIG. 8 the details of tongues 42 are visible, with the lugs 43, born by the base 2 of the outer case 1.

Figure 9:
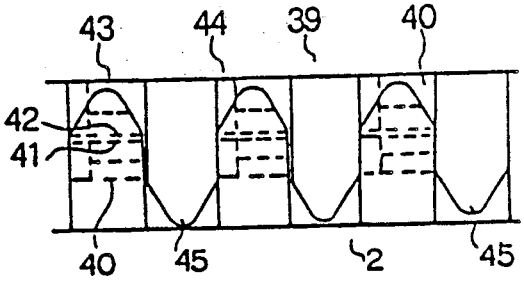
FIG. 9 is a peripheral development which shows the position of the snap fastening means of FIGS. 7 and 8 engaged with each other.

On FIG. 9 the positions of tongues 40 engaged with the tongues 43 are visible in a plane development of the platform 39.

Figure 10:
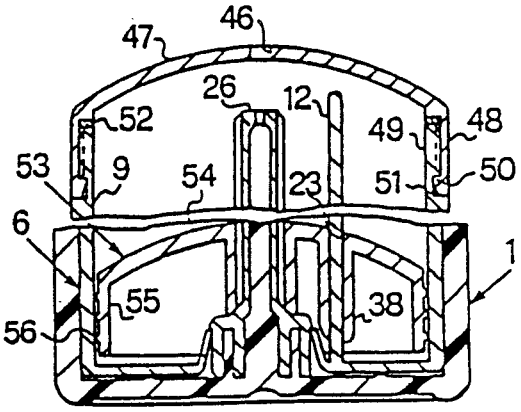
FIG. 10 is a partial view of an embodiment of a container for dispensing viscous fluid product of creamy type.

In FIG. 10 a partial view of the container is shown in an embodiment suitable for a viscous fluid, such as cream, milk, gel, doughy subsances and the like, which must be dispensed through an aperture or hole 46.

In the figure the sheath 6 is closed by a transversal wall 47, preferably convexed, fixed to the reduced thickness upper portion 49 of the sheath by a flange 48.

As a modification, the flange 48 may extend along the entire wall 9, such as to be the only projecting wall above the upper extremity of the case 1.

An annular projection 50, projecting inwardly, realized on the flange 48, snaps locked in a respective groove 51, provided on the upper portion 49 of the sheath 6.

Between the transversal closure wall 47 and the upper end of the sheath 6 is inserted a ring gasket 52 to guarantee a hermetic seal between the two bodies.

The propelling carrier in the shape of a pressing piston 43, consists of a transversal wall 54 and a skirt 55. The transversal wall 54 is preferably convex, or complementary to the wall 47, to push the viscous fluid product. The skirt 55 projects downwardly and is provided with annular ribbings 56, capable of pressing elastically along the whole periphery of the inner surface 8 of the sheath 6 to afford a peripheral hermetic seal.

The piston 43 slides along the guide rod 12 by way of an aperture 23 on its wall 54. The aperture 23 is provided with an appendix 38 along its edge, projecting downwardly towards the base, to obtain a larger contact surface with respect to the simple aperture 23.

Figure 11:
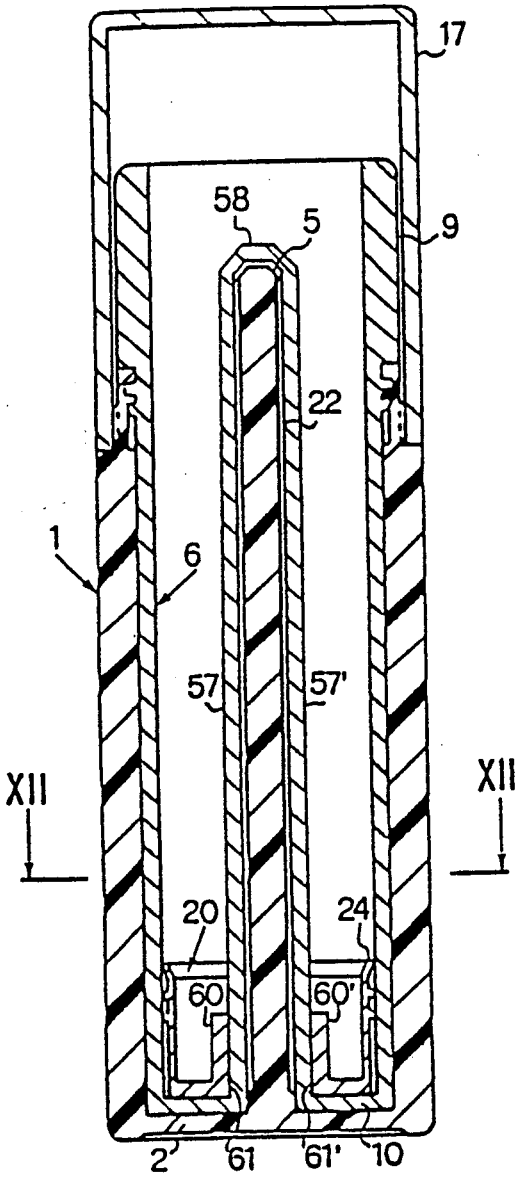
FIG. 11 is a modification of FIG. 1 with a double guide rod.
Figure 12:
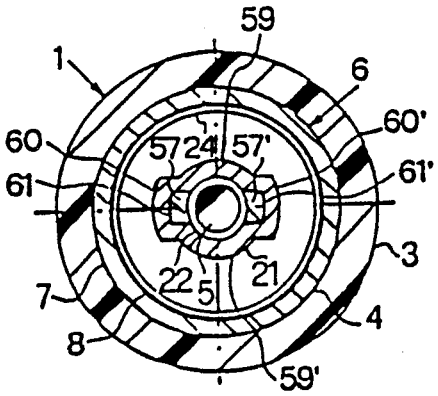
FIG. 12 is a section along line XII—XII of FIG. 11.

In FIG. 11 and FIG. 12, a modified embodiment of FIG. 1 is shown, in which the guiding of cup 20 is realized by two rods 57 and 57', positioned on opposite sides with respect to the axis, and tightly fitted to the screw 22 of the shaft 5. Both rods are integral with the bottom 10 of the sheath 6 and project towards the top.

The upper ends of the opposite guide rods 57 and 57' are joined above at 58 of the upper end of the screw shaft 5. In such a way, they may be realized as a single piece, riding on said screw shaft 5, and in a symmetrical position with respect to it, instead of being offset.

The threading of the tubular inner projection 21 of the cup 20, instead of having a circular structure as in the previous figures, consists of two circular sectors 59 and 59', opposite with respect to the axis, and two tubular wings 60 and 60', which surround the guide rods 57 and 57'.

The apertures 61 and 61', on the floor of the cup 20, allow the sliding of the cup on rods 57 and 57'. The apertures 61 and 61, are continuous with the threaded hole of the projection 21 of the cup, such as to form altogether a single aperture.

The guide rod realized with such a structure affords a better centering of the cup in the assembly operation and a better stability and solidity along its length.

While having described the invention in considerable detail in various embodiments, it is understood that all fall within a single inventive concept which characterizes the fundamental structure of the container in the present invention.

We claim:

1. Dispenser container of a solidified stick or viscous fluid product, comprising a tubular outer case, with inner surface of circular cross-section, open at its top end and with a closed base, and a screw threaded shaft rigidly connected to said closed base extended along the axis of said case, a tubular inner sheath, coaxial to said outer case with a lower part having an outer cylindrical surface rotatable in sliding contact with inner surface of the case and a closed bottom provided with an aperture, and an upper portion projecting above said case, a movable carrier threadedly coupled with said screw shaft through a central aperture and having a transversal diaphram and an outer wall in sliding contact with the inner surface of the inner sheath, with elastic friction peripheral hermetic seal, engagement means on the sheath and on the case appropriate for preventing a reciprocal movement in the axial direction of the sheath and the case, so that these are allowed only a relative rotatory movement around their common longitudinal axis, and a cap, characterized by the fact that at least one guide rod off-centre with respect to said axis and parallel to it is fixed rigidly to the bottom in said inner sheath, and said movable carrier provides an aperture on the transversal diaphram with which said guide rod is engaged in a sliding manner, and by which the relative rotation of the sheath and the case determines a sliding of the carrier at the inside of the sheath, guided by said screw shaft and by said off-centre guide rod.

2. Container according to claim 1, in which two guide rods are positioned adjacent and in contact with said screw shaft, on its horizontally opposite sides, said carrier having a central aperture formed in such a way to be threadedly engaged with horizontally opposite sectors of the screw of the shaft and in sliding contact with said rods, on horizonatally opposite sides, effectively at 90° with respect to said horizontally opposite sectors.

3. Container according to claim 2, in which said two guide rods are rigidly joined between themselves above the free end of said screw shaft.

4. Container according to claim 1, in which said screw shaft is formed by two members comprising a post projecting from said base of said case and a hollow elongated screw threaded member provided with an outer screw, assembled on said post and rigidly connected to it.

5. Container according to claim 4, in which said hollow elongated screw threaded member is rigidly connected to said post by glueing, ultrasounds or forced coupling.

6. Container according to claim 4, in which the base of said case is provided with a circular cylindrical flange concentric to said post and said hollow elongated member comprises a flange having a circular cavity which can be rigidly engaged with said flange.

7. Container according to claim 6, in which said flange of the hollow elongated member comprises a transversal platform provided on its periphery with a succession of tongues turned downwardly, having on their extremities small lugs acting as small undercuts and the base of the case is provided with a succession of tongues turned upwardly having lugs which can snap-lock with said lugs on the hollow member to make it rigid to said case.

8. Container according to claim 7, in which each tongue on the hollow screw is joined by a Z-shaped joining to a respective positioning and centering tongue placed on a more inner circumference on said transversal platform.

9. Container according to claim 6, in which said engagement means on the outer case and on the inner sheath comprise at least one annular rib on the base of the screw shaft and an aperture provided on the bottom wall of the inner sheath, where said rib is snap-locked.

10. Container according to claim 7, in which said means of engagement on the outer case and on the inner sheath comprise said succession of tongues turned towards the bottom on the base of the screw shaft and said tongues are engaged on the edge of the central aperture on the bottom wall of the outer sheath.

11. Container according to claim 1, in which said means of engagement on the outer case and on the inner sheath comprise a part of the upper wall of the outer case with a reduced thickness starting from the inner surface, and from the outer surface of the case, annular ribbings projecting inwardly on said reduced wall part and annular ribbings projecting outwardly on said sheath, which engage by snap fastening with free rotational movement and axial movement constraint.

12. Container according to claim 1, in which the means for the peripheral sealing by elastic friction comprise a flared edge and, or annular ribbings on the outer surface of the carrier pressing elastically on the inner surface of the inner sheath.

13. Container according to claim 1, in which the edge of said aperture of the carrier is provided with a tubular wall projecting from the transversal surface, such as to be in sliding contact with the guide rod along an extended surface.

14. Container according to claim 1, in which the tubular wall of the inner sheath has a variable thickness and its inner surface is elliptical, oval, heart-shaped or poligonal in cross-section and the respective wall of the carrier has a complementary configuration to this one.

15. Container according to claim 1, in which the cap and the inner sheath, or the outer case are realized of plastic material.

16. Container according to claim 1, in which said transversal diaphram of the movable carrier is positioned half way up said outer wall and is provided with apertures to allow the perculation of fluid product underneath said diaphram during pouring of said material for stick products.

* * * * *